United States Patent [19]

Cain

[11] Patent Number: 4,827,554

[45] Date of Patent: May 9, 1989

[54] PAINTBRUSH CLEANING APPARATUS

[76] Inventor: Charles R. Cain, 259 Winn St., Burlington, Mass. 01803

[21] Appl. No.: 171,591

[22] Filed: Mar. 22, 1988

[51] Int. Cl.[4] ..... A46B 17/06

[52] U.S. Cl. ..... 15/142; 211/65; 220/90

[58] Field of Search ..... 15/1, 142, 104 R, 141.4; 220/90; 211/70.6, 65, 66; 248/110; 99/418

[56] References Cited

U.S. PATENT DOCUMENTS

| | | | |
|---|---|---|---|
| 2,101,487 | 12/1937 | Anderson | 99/418 |
| 2,827,647 | 3/1958 | Speer | 15/142 |
| 4,099,286 | 7/1978 | Ishikawa | 15/142 |
| 4,247,013 | 1/1981 | O'Hori | 220/90 |
| 4,494,267 | 1/1985 | Fredley | 15/1 |

*Primary Examiner*—Robert W. Jenkins

*Attorney, Agent, or Firm*—Robert F. Ziems

[57] ABSTRACT

A paintbrush cleaning apparatus which when inserted within one of a variety of suitable conventional waste-baskets provides for cleaning of a paintbrush for reuse while at the same time eliminating splattering, retaining excess thinner for reuse and preparing the paintbrush for the next color. The apparatus is especially suited for cleaning paintbrushes for reuse by artists using a wet on wet painting system. The apparatus employs a plurality of living hinges so that it can be used by either a sitting or standing artist.

5 Claims, 2 Drawing Sheets

FIG. 1
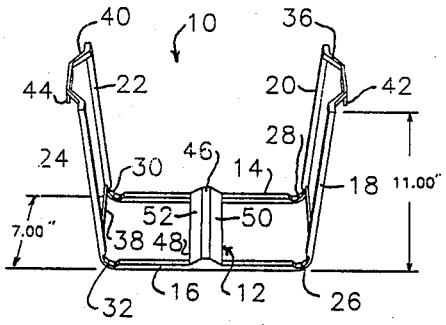
FIG. 2
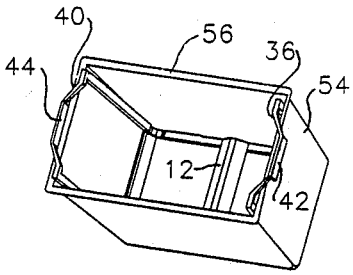
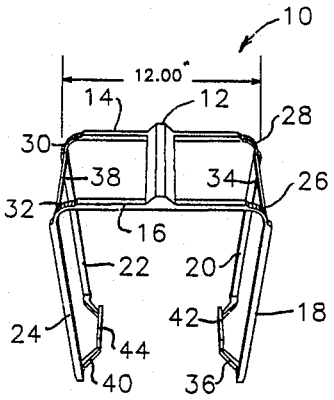
FIG. 3
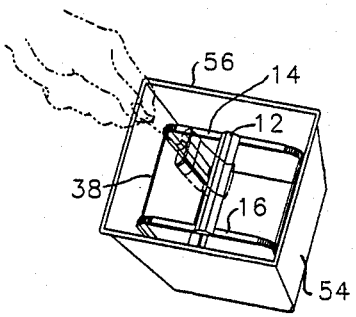
FIG. 4

FIG. 5
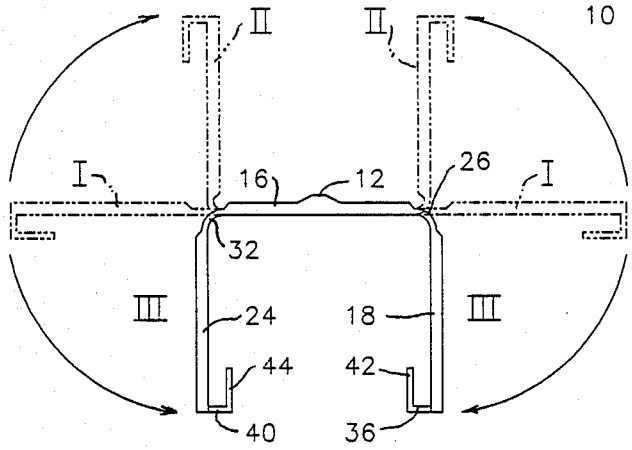
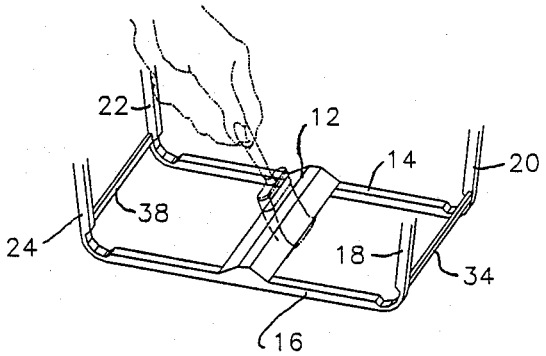
FIG. 6

PAINTBRUSH CLEANING APPARATUS

BACKGROUND OF THE INVENTION

This invention relates to painters equipment and, more particularly, it concerns paintbrush cleaning apparatus for facilitating the cleansing of used paintbrushes.

The problems associated with cleaning paints from wet paintbrushes for use with a different color of paint are well known. Cleansing of the wet paintbrush requires that the paintbrush be dipped in a container of thinner or solvent and then forcefully shaken to remove paint and thinner. In so doing, the artist or painter has splattered paint and thinner over the surrounding area. Additionally, the painter may have to remove even more thinner from the paintbrush to prepare the brush for application of the next color by pressing the bristles between the folds of a paper or cloth towel to ensure that as much of the thinner is removed as possible. Such a paintbrush cleaning process is undesirably messy and time consuming.

The problems associated with cleaning used paintbrushes are accentuated when an artist uses a wet on wet type painting system. For example, there are numerous television programs which feature an artist who produces a painting in half an hour or less. Such an artist uses a wet on wet painting system in which the canvas has been prepared ahead of time with a wet white paint base which stays wet during the painting process. This allows the artist to correct mistakes by simply wiping the colored paint from the wet white paint base. To paint the different colors over the white paint base, the artist reuses the same paintbrush. This requires numerous cleanings of the paintbrush for reuse. Usually, the artist cleans the paintbrush by dipping the paintbrush in a container of thinner and then whacking the paintbrush on the easel to forcefully remove paint and thinner from the bristles. The whacking of the paintbrush on the easel causes a splattering of a mixture of thinner and paint over a large area of the studio. This paintbrush cleaning technique not only is undesirable from the standpoint of requiring extensive cleaning of the studio but also because a large amount of thinner is wasted in that it cannot be reclaimed for further use.

Thus, a need exists for a paintbrush cleaning apparatus which would eliminate splatter, retain thinner for reuse and provide for a thorough cleaning of the paintbrush. This need is especially acute for artists using a wet on wet type painting system which requires numerous paintbrush cleanings to accommodate sequential application of a multiplicity of different paint colors. Further, there is a need for a paintbrush cleaning apparatus which will accommodate artists who paint in either a standing or sitting position.

SUMMARY OF THE INVENTION

In accordance with the present invention, a paintbrush cleaning apparatus is provided by which wet paintbrushes may be cleaned in a manner in which splatter is eliminated, thinner is retained for reuse and the paintbrush is prepared for the next painting step.

The paintbrush cleaning apparatus of the present invention is embodied in an integral plastic formation including a striker bar, a pair of horizontal members supporting the striker bar at its ends and four vertical legs each being hingedly attached to a different end of one of the horizontal members. Adjacent legs are attached to one another by a first crossmember intermediate their ends and by a second crossmember at the ends of the legs opposite the ends connected to the horizontal members. Each of the second crossmembers supports a planar tab in a plane parallel to but offset from a plane defined by the adjacent leg members. The tabs provide for mounting the paintbrush cleaning apparatus in an open top receptacle such as a wastebasket with the striker bar within and elevated from the bottom of the receptacle.

The legs of the paintbrush cleaning apparatus are attached to the horizontal support members by living hinges so that the paintbrush cleaning apparatus can be placed in either a first or second orientation within a wastebasket depending on whether the artist is to be painting in a standing or sitting position. If the artist wishes to paint while sitting, the living hinges are bent so that the legs of the paintbrush cleaning apparatus extend above the striker bar and the crossmember tabs can be placed outside the upper rim of the wastebasket. With the tabs so located, the striker bar is supported in a position within the lower confines of the wastebasket. When the artist wishes to paint while standing, the living hinges are bent in the opposite direction so that the legs are directed below the striker bar. In this position, the legs support the striker bar at a location within the upper confines of the wastebasket.

A principal object of the invention therefore is the provision of a paintbrush cleaning apparatus for placement within an open top receptacle such as a wastebasket in one of two orientations by which cleaning of a wet paintbrush is facilitated in that splatter is eliminated, thinner is captured for reuse and the paintbrush is prepared for the next painting step. Another object of the present invention is the provision of such a paintbrush cleaning apparatus which is particularly suited for the cleaning of paintbrushes used in a wet on wet painting system. Other objects and further scope of the applicability of the present invention will become apparent from the detailed description to follow taken in conjunction with the accompanying drawings in which like parts are designated by like reference characters.

BRIEF DESCRIPTION OF THE DRAWINGS

FIG. 1 is a perspective view illustrating the paintbrush cleaning apparatus of the present invention in a first orientation;

FIG. 2 is a partial perspective view representation of the paintbrush cleaning apparatus of FIG. 1 in an operative position inside of a wastebasket;

FIG. 3 is a perspective view illustrating the paintbrush cleaning apparatus of the invention in a second orientation;

FIG. 4 is a partial perspective view representation of the paintbrush cleaning apparatus of FIG. 3 in an operative position within a wastebasket;

FIG. 5 is a side elevation representation of the present paintbrush cleaning apparatus being bent to the first orientation of FIG. 1 and then to the second orientation of FIG. 3 to produce four living hinges; and FIG. 6 is a partial perspective view illustrating use of the paintbrush cleaning apparatus of FIG. 2.

DETAILED DESCRIPTION OF THE PREFERRED EMBODIMENT

In FIGS. 1, 3 and 5 of the drawings, the paintbrush cleaning apparatus of the present invention is generally designated by reference numeral 10 and shown to be of unitary construction formed of suitable synthetic resinous or plastic materials shaped by known injection molding techniques. The apparatus 10 includes a striker bar 12 supported at its ends by a pair of horizontal support members 14 and 16. Each of four legs 18, 20, 22 and 24 is pivotally attached to a different end of the horizontal supports 14 and 16 by a flexible hinge 26, 28, 30 and 32, respectively. Adjacent legs 18 and 20 are joined by a first crossmember 34 near the hinges 26 and 28 and by a second crossmember 36 at the ends of the legs opposite the hinges 26 and 28. Likewise, the legs 22 and 24 are joined by a first crossmember 38 and a second crossmember 40. Each of the respective crossmembers 36 and 40 has a centrally located, planar tab 42 and 44 which defines a plane offset from but substantially parallel to a plane defined by the legs 18 and 20 and 22 and 24, respectively. With reference to FIG. 1, the striker bar 12 preferably has an isosceles trapezoid cross section defined by horizontal upper and lower surfaces 46 and 48 and a pair of angled sides 50 and 52. This shape provides for maximum cleaning of a paintbrush as described in more detail below.

As shown in FIGS. 1, 2 and 6 of the drawings, the hinges 26, 28, 30 and 32 have been bent so that the legs 18, 20, 22 and 24 extend above the striker bar 12. In this position, the apparatus 10 may be inserted into a conventional open top receptacle such as a wastebasket 54 having a substantially rectangular opening defined by an upper rim or lip 56 as shown in FIG. 2. The legs 18 and 20, crossmember 36 and tab 42 together form a first hook like formation. Similarly, the legs 22 and 24, crossmember 40 and tab 44 form a second hook like formation. As shown in FIG. 2, these first and second hook formations are placed over opposite edges of the rim 56 so that the striker bar 12 hangs within the wastebasket 54 in a position parallel to but raised up from the bottom of the wastebasket. As such, the striker bar 12 is located near the bottom of the wastebasket and in so being provides for maximum splatter control. Given the exemplary dimensions set forth in FIGS. 1 and 3, where the paintbrush cleaning apparatus is about 7 inches wide, 12 inches long and 11 inches tall, the apparatus 10 may be used with any one of a variety of commercially available conventional wastebaskets 54. The wastebasket 54 may be selected to have dimensions so that the rim 56 defines an opening which is at least 7 inches wide and 12 inches long and to have a depth of at least 13 inches, for example. Thus, the striker bar 12 would be located sufficiently from the bottom of the wastebasket to accommodate a build up of paint and thinner in the bottom of the wastebasket.

With the apparatus in the position shown in FIG. 2, an artist can thoroughly clean a paintbrush for reuse by, first, dipping the paintbrush in a container of thinner (not shown), then shaking the paintbrush in the wastebasket 54, and finally, rapidly striking the paintbrush in a back and forth motion against the striker bar 12 (FIG. 6). This cleaning process removes the paint and thinner from the paintbrush and prepares the paintbrush for the next painting step. Numerous paintbrush cleanings will leave a mixture of paint and thinner in the bottom of the wastebasket. In time, the paint will settle to the bottom and the thinner can be removed for reuse.

The placement of the striker bar 12 near the bottom of the wastebasket 54 as shown in FIG. 2, is suited for an artist who is painting in a sitting position. If the artist chooses to paint in a standing position, then the paintbrush cleaning apparatus should be removed from the wastebasket 54, bent so as to be in the orientation shown in FIG. 3 and placed back in the wastebasket 54 as shown in FIG. 4. In the position shown in FIG. 3, each of the crossmembers 36 and 40 has an angled contour which forms a pedestal for supporting the apparatus on the bottom of the wastebasket 54 as shown in FIG. 4. In this manner, the striker bar 12 is located near the top of the wastebasket so that a standing artist need not bend or stoop radically to clean a paintbrush for reuse. With respect to FIG. 4, the paintbrush is cleaned in the same manner as described above by first, dipping the paintbrush in a container of thinner (not shown), second, shaking the paintbrush inside the wastebasket 54 and then, lastly, striking the paintbrush in a back and forth motion against the striker bar 12 to remove substantially all of the paint and thinner from the paintbrush. Likewise, when the paint and thinner in the wastebasket separate, the thinner may be drained off for reuse.

In FIG. 5 of the drawings, formation of the living hinges 26, 28, 30 and 32 is illustrated as a three step process where the first two steps are shown in dashed lines and the last step is shown in solid lines. The paintbrush cleaning apparatus 10 is molded in a substantially planar configuration as shown by the dashed lines designated by the numeral I. Immediately after molding, the legs 18, 20, 22 and 24 are pushed up to the raised position II to flex the hinges 26, 28, 30 and 32, respectively. Next, the legs 18, 20, 22 and 24 are bent downward to the position III so that the hinges 26, 28, 30 and 32 are flexed in the opposite direction. This procedure relieves the stress in the hinges and forms living hinges which can be bent countless times from the position of FIG. 1 to the position of FIG. 3 without breaking. Such living hinges have a preferred thickness in the range of 1/16 to $\frac{1}{8}$ of an inch when the apparatus 10 has the exemplary dimensions given in FIGS. 1 and 3. Such an apparatus has been found to work well with paintbrushes having a width of about one inch or more.

Thus, it will be appreciated that as a result of the present invention, a highly effective paintbrush cleaning apparatus is provided and by which the stated objectives, among others, are completely fulfilled. Additionally, the paintbrush cleaning apparatus 10 of the present invention lends itself to ease in shipping and storage in that the apparatus may be packaged by folding both legs over the striker bar and the horizontal support members 14 and 16. Moreover, the design of the present apparatus 10 allows an artist to place a conventional receptacle liner such as a plastic trash bag inside the receptacle before insertion of the apparatus 10 in order to keep paint and thinner from contacting the receptacle. Due to its synthetic resinous or plastic construction, the apparatus 10 is easily cleaned with conventional paint thinners and solvents. It is contemplated that modifications and/or changes may be made in the illustrated embodiment without departure from the invention. For example, while a striker bar having an isosceles trapezoidal cross section is shown in the illustrated embodiment, striker bars having other shapes may be used. Also, although an apparatus having a unitary construction is shown in the illustrated embodiment, an apparatus made up of separate components glued or welded together may be used.

Further, it will be apparent to those skilled in the art from the foregoing description and accompanying drawings that additional modifications and/or changes may be made, again without departure from the invention. Accordingly, it is expressly intended that the foregoing description and accompanying drawings are illustrative of a preferred embodiment only, not limiting, and that the true spirit and scope of the present invention be determined by reference to the appended claims.

I claim:

1. A paintbrush cleaning apparatus for use within an open top receptacle such as a wastebasket, comprising:

striker bar means supported at its ends by a pair of horizontal support members; and leg means pivotally connected to the horizontal support members by a plurality of flexible hinge means;

said striker bar means, horizontal support members, leg means and plurality of flexible hinge means being formed as a unitary component.

2. The paintbrush cleaning apparatus of claim 1, wherein the plurality of flexible hinge means are a plurality of living hinges.

3. The paintbrush cleaning apparatus of claim 2, further comprising:

crossmember means for joining adjacent leg means and for supporting a planar tab.

4. The paintbrush cleaning apparatus of claim 3, wherein the plurality of living hinges may each be bent in either of two directions so that the striker bar means may be selectively located in one of a first position near the bottom of the receptacle and a second position near the top of the receptacle.

5. The paintbrush cleaning apparatus of claim 4, wherein said striker bar means has an isosceles trapezoidal cross section.

* * * * *